United States Patent [19]

Golladay et al.

[11] 4,111,006

[45] Sep. 5, 1978

[54] APPARATUS FOR PRODUCING PATTERNED DEEP PILE CIRCULAR KNITTED FABRICS

[75] Inventors: James D. Golladay, Wauwatosa; Norman C. Abler, Menominee Falls, both of Wis.

[73] Assignee: Bunker Ramo Corporation, Oak Brook, Ill.

[21] Appl. No.: 848,646

[22] Filed: Nov. 4, 1977

Related U.S. Application Data

[62] Division of Ser. No. 689,066, May 24, 1976, which is a division of Ser. No. 358,398, May 8, 1973, Pat. No. 3,973,414.

[51] Int. Cl.[2] ..... D04B 9/14

[52] U.S. Cl. ..... 66/9 B; 66/115

[58] Field of Search ..... 66/9 B, 61, 80, 83, 66/115, 116, 121, 122, 123

[56] References Cited

U.S. PATENT DOCUMENTS

| | | | |
|---|---|---|---|
| 1,848,370 | 3/1932 | Moore | 66/9 B |
| 3,115,760 | 12/1963 | Pierce | 66/115 X |
| 3,709,002 | 1/1973 | Brandt et al. | 66/9 B |

FOREIGN PATENT DOCUMENTS

| | | | |
|---|---|---|---|
| 315,055 | 7/1929 | United Kingdom | 66/115 |

*Primary Examiner*—Robert R. Mackey
*Attorney, Agent, or Firm*—F. M. Arbuckle; J. Klooster

[57] ABSTRACT

A pile fabric knitting apparatus has controllable means, several representative embodiments of which are disclosed, separate from fiber supply means and responsive to dynamic control means, i.e., transducer, control tape, etc., functioning during operation of the apparatus, for regulating the quantity of pile fibers transferred to or retained by the reciprocating knitting needles from respective fiber zones provided by pile fiber feeding means to which the fibers are delivered by the supply means. Such controllable means may operate in addition to or alternatively to fiber supply control at the supply means. In a preferred form the needles comprise companion relatively slidably operative needle elements, one of which elements is adapted to transfer more fiber than the other of said elements, and the controllable means are operative to select the elements for picking up fiber in any of the respective fiber zones.

3 Claims, 28 Drawing Figures

APPARATUS FOR PRODUCING PATTERNED DEEP PILE CIRCULAR KNITTED FABRICS

This is a divisional application of application Ser. No. 689,066 filed May 24, 1976, which was a division of Ser. No. 358,398 filed May 8, 1973, now U.S. Pat. No. 3,973,414, issued Aug. 10, 1976.

BACKGROUND OF THE INVENTION

This invention relates to sliver knitting machines and more particularly to the production of intricate pattern effects in circular knit deep pile fabrics.

In a typical commercial installation, deep pile fabrics are manufactured on circular knitting machines equipped with carding means that take fibers from slivers, or other loosely bound fiber assemblies, and supply these fibers to the hook portions of the knitting needles. Body yarns also are supplied to the hook portions of the knitting needles, and as the needles are manipulated to draw the body yarns into interlocked loops, the pile fibers supplied by the carding means are bound in with the body yarn loops. The end portions of the fibers project from the body yarn loops to form a pile surface on the knitted fabric. Ordinarily, air jets are directed toward the hook portions of the needles so as to dispose the pile fibers on the inside surface of the circular knit fabric. After the knitting operation, the tubular fabric is slit longitudinally and subjected to suitable finishing treatments such as shearing and the like.

Various techniques for achieving pattern effects in these knitted pile fabrics have been used heretofore. Of particular interest is the technique disclosed in U.S. Pat. No. 3,413,823 to Beucus et al., wherein pile fibers of different characteristics are delivered to axially spaced surface portions of the doffer element of the fiber feeding and carding head at each feed station, and the knitting needles are selectively raised into contact with one or more of the doffer surface portions to pick up fibers of the characteristics required for achieving the desired pattern effect.

Although such apparatus is quite satisfactory for the production of many patterns, it is less than ideally suited to the production of patterns wherein there are long intervals between stitches incorporating fibers of a given color. In these instances, such problems as undesired fiber buildup in the fiber feeding and carding lines may develop due to a lack of correlation between the fiber input and fiber utilization. Additionally, the cam system of needle selection specifically disclosed in the Beucus et al U.S. Pat. No. 3,413,823 is best suited to the production of short "repeats" or pattern sections, rather than the more intricate, long "repeat", pattern effects such as pictorial representations and the like.

In Brandt et al U.S. Pat. No. 3,709,002 these problems were very materially reduced by providing automatic coordination of fiber supply and needle selections. Due, however, to the difficulty of programming some intricate fabrics and, in some pattern situations due to an inadequate response characteristic, the fiber delivering means, i.e. doffer may experience an excessive fiber build-up or an uneven fiber delivery and needles taking fibers therefrom may pick up an overload or may be starved or underloaded, causing undesirable unevenness and variations in the fabric stitches and the pile of the fabric.

In addition, merely controlling fiber delivery in the fiber supply area of the machine places a limitation upon pattern design. Although in general designs may be attained by replacement of variously colored fibers in the pile of the fabric, desirable design effects may be attainable by variations in pile density at selected areas of a single color pile fabric. Prior arrangements have seriously limited or precluded attainment of numerous and varied desirable pattern effects.

While it is well known, of course, that during machine set-up, the depth of penetration of the needles can be predetermined by the proper positioning of the doffer rolls relative to the reach of the needles, the set-up adjustments are only feasible while the machine is inactive and remains static during operation of the apparatus. Any attempt to effect adjustments of the doffers relative to the needles during operation of the apparatus would, in prior apparatus, involve extreme hazard not only to the apparatus such as liability of needle breakage, but also to manipulating personnel. Therefore, in prior apparatus any change in adjustment of the normally static adjustment has necessarily been carefully avoided. To the best of our knowledge and information, there has been no prior suggestion that regulation of the quantity of pile fibers transferred to the knitting needles from the fiber delivery or supply means could be effected at the needles or the point of take-off of fibers by the needles at the fiber delivery means while running.

SUMMARY OF THE INVENTION

It is an object of this invention to overcome the disadvantages, deficiencies, shortcomings and problems noted above. More particularly, it is an object of the invention to provide in pile fabric knitting apparatus new and improved means for regulating the quantity of pile fibers transferred to the knitted fabric by the knitting needles from the respective ones of the fiber zones provided by the pile fiber supply means and delivery means, and having the great flexibility required for the production of extremely intricate patterns in deep pile knitted fabrics. We have found it desirable to provide controllable means other than the fiber supply means and responsive to dynamic manual or automatic control means functioning rapidly during operation of the apparatus to effect regulation of the quantity of pile fibers transferred to the knitting needles from the fiber zones, as by varying needle pick-up from the zones, or by removing excess fiber from the needles to modulate the needle load.

In a preferred embodiment, needle selection is effected under the control of one or more intelligence indicia bearing media such as tapes of whatever capacity or length may be required to produce the desired pattern. With this system, the indicia stored in, carried by or on the medium determine which, if any, fiber is picked up by each needle on any given pass of that needle by a fiber feed station. The fiber supplies to the various feed lines are similarly controlled by the same or an additional preprogrammed indicia system. Clutches or the like, actuated from the indicia, control the fiber input quantities to correlate them with the needle selections and therefore the fiber utilization quantities. In addition, or alternatively thereto, an immediate control is provided at the point of fiber pick-up by the successive needles or immediately thereafter for regulating the quantity of pile fibers transferred by the needles to the knitted fabric, said immediate control being controlled either independently or by said indicia medium.

BRIEF DESCRIPTION OF THE DRAWINGS

A more complete understanding of the invention will be gained from a consideration of the following detailed description of several embodiments illustrated in the accompanying drawings, in which.

DESCRIPTION OF THE PREFERRED EMBODIMENT

Figure 1:
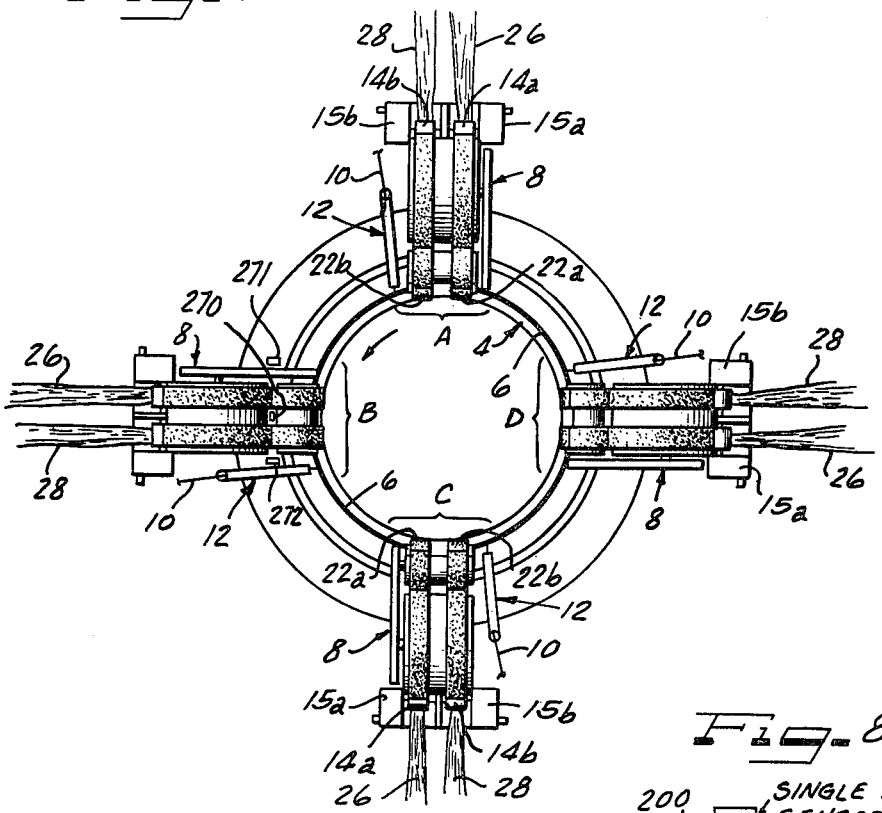
FIG. 1 is a somewhat diagrammatic plan view illustrating a circular knitting machine embodying features of the invention.
Figure 2:
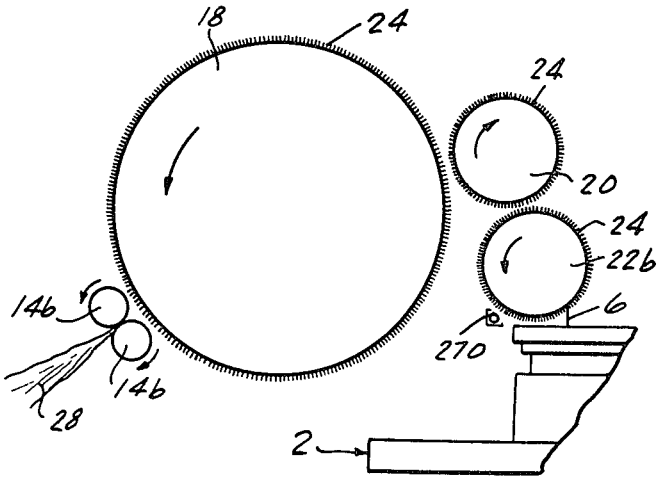
FIG. 2 is a diagrammatic elevational view depicting one of the pile fiber carding and feeding units of the apparatus shown in FIG. 1.

The general organization of the machine elements will be evident from FIGS. 1 and 2. Stationary frame means suggested at 2 serves to support a rotating needle cylinder 4 carrying vertically reciprocable knitting needles 6 in slots or grooves on its periphery. As the needle cylinder 4 rotates past a feed station A, selecting knitting needles 6 are moved upwardly in sequence to receive in their hook portions pile fibers from a carding and feeding unit 8 and a body yarn 10 from supply means indicated at 12. Then each needle is moved downwardly to draw a loop of the body yarn 10 through a previously formed body yarn loop, to cast off such previously formed body yarn loop, and to cause the pile fibers to become interlocked with the body yarn loops. This sequence is repeated at each of the remaining stations B, C and D, so that four courses of body yarn stitches are formed during each revolution of the cylinder. Air jets, not shown, are directed toward the needles 6 in the customary manner to orient the pile fibers so that they protrude from the body yarn loops radially inwardly toward the interior of the knitted tube.

The number of stations A, B, etc., should be as great as is permitted by space limitations and the like, because the rate of fabric production is a function of the number of feeds and economy is important in the manufacture of deep pile knitted fabrics. Four feed stations have been illustrated in FIG. 1 as exemplary of suitable high production equipment. The invention may be applied in machines having any number of feeds operated to produce a like number of courses of knitted stitches during each revolution of the cylinder.

Each of the pile fiber carding and feeding units 8 includes two pairs of sliver feed rollers 14*a* and 14*b* controlled respectively by clutch units 15*a* and 15*b*, a main drum 18, a transfer roll 20, and a doffer 22. These components are rotated in the direction indicated by the arrows in FIG. 2, and all of them except the sliver feed rollers 14*a* and 14*b* bear conventional card clothing 24 on their peripheries. However, as indicated in FIG. 1, there is a centrally located gap in the card clothing on each of the components 18, 20 and 22. By reason of these gaps in the card clothing, the unit 8 is divided into two axially spaced apart fiber paths or lines.

Ordinarily, slivers of different types are supplied to each of the units 8. In FIG. 1, the numerals 26 and 28 have been applied to two slivers that differ from one another in color and/or in some other characteristic. For purposes of explanation, it will be convenient to assume that the fibers of the slivers 26 are white and that the fibers in the slivers 28 are red. The white fibers are delivered to the feed rolls 14*a* and the red fibers are delivered to the feed rolls 14*b*. The gaps in the card clothing serve to keep the fibers from the respective slivers in spaced paths as they move through the unit 8. Hence, the card clothing at one end portion 22*a* of the doffer 22 will be supplied with white fibers from the sliver 26 and the card clothing at the other end portion 22*b* of the doffer will be supplied with red fibers from the sliver 28.

The manner in which the knitting needles 6 are caused to cooperate with the doffers 22 of the various fiber carding and feeding units 8 to transfer fibers from the fiber feeding zones provided thereby to the knitted fabric will now be explained in connection with FIGS. 3 and 4. These views illustrate the structures located at one of the feed stations, and it will be understood that the other stations are similar.

In the embodiment illustrated, three elements are disposed within each of the vertical slots 30 at the periphery of the needle cylinder 4. The uppermost element is a latch needle 6 having a hook portion 6*a* at its upper end and an outwardly extending butt portion 6*b* located above its lower end. An intermediate positioning jack 32 is located beneath each knitting needle 6 and is movable vertically in its slot 30 with its upper end bearing against the lower end of the needle 6. The lowermost element in each of the cylinder slots 30 is a pattern jack 34, the upper end of which bears against the lower end of the positioning jack 32. The pattern jack 34 is movable vertically in its slot 30, and the lower end portion of the pattern jack 34 also is movable radially in its slot 30.

As manufactured, each pattern jack 34 has a plurality of outwardly projecting tabs 36 on its outer edge. Two of these tabs are depicted diagrammatically in FIG. 4, but it will be understood that similar tabs are located in the area between those illustrated. These tabs are so fabricated that individual ones of them may be removed from the pattern jack 34 by the machine mechanic, and ordinarily all but one of them will be broken off prior to installation of the pattern jack in its slot 30 in the outer cylindrical wall of the needle cylinder 4. The tabs cooperate with selectors 38 movably mounted in selector banks 40 containing means for moving the selectors 38 individually toward the needle cylinder 4 and permitting retraction thereof away from the needle cylinder 4. When a pattern jack 34 having a tab 36 at a given level moves past an extended selector 38 at the same level, the pattern jack is moved radially inwardly in its slot 30. These mechanisms are well known in the art and need not be described in greater detail here.

Stationary cam means 42 (FIG. 4) extend circumferentially of the needle cylinder 4 in spaced relation thereto for cooperation with the needle butts 6*b* and with butts 32*b* on the positioning jacks 32. The cam means 42 are arranged to provide cam slots 44 and 46 through which the needle butts 6*b* and the jack butts 32*b* move as the needle cylinder 4 rotates past the stationary cam means.

Additional stationary camming devices 48 and 50 are provided adjacent the needle cylinder opposite the lower end portions of the pattern jacks 34. The cams 48 bear outwardly against the inner edges of the protruding lower end portions 34*a* of all the pattern jacks 34, so that all of the lower end portions of the pattern jacks will be moved outwardly in their slots 30 as the pattern jacks move past a cam 48. In this connection, it will be understood by those skilled in the art that the pattern jacks 34 are bent slightly so as to frictionally engage the walls of their slots 30 and thereby maintain whatever positions are given them. That is to say, a pattern jack 34 will remain stationary in its slot 30 following movement by cams 48, 50, 52 and/or 54 until some further affirmative action is taken to positively change such position.

The cams 50 have upwardly facing cam surfaces 50*a* spaced outwardly from the periphery of the needle cylinder 4. These are intended for cooperation with cam follower tabs 34*b* near the lower ends of the pattern jacks 34, the spatial relationship being such that each jack 34 may either move passively past a cam 50 or be acted upon by the cam 50 depending upon whether the lower end portion of the jack 34 is disposed inwardly or outwardly in its slot 30. When the lower end portion of a pattern jack 34 is disposed outwardly in its slot 30, its cam follower tab 34*b* will contact the cam surface 50*a* of a cam 50, and as the cylinder 4 rotates, the pattern jack 34 will be raised vertically in its slot 30.

The various camming and selector components referred to above cooperate to control the vertical movements of the knitting needle 6 as the needles move past the various feed stations A, B, etc. of the machine. The sequence of effects produced on a given needle 6 as it moves past a feed station can best be explained with reference to FIG. 4 of the drawings. In considering this view, it will be assumed that the needle cylinder slot bearing the diagrammatically illustrated needle 6, positioning jack 32 and pattern jack 34 is moving from right to left.

As the illustrated pattern jack 34 moves to the left from the illustrated position, its downwardly protruding lower end 34*a* will be urged outwardly in its cylinder slot by the first cam 48. This has no immediate effect on the vertical position of the selector jack 34.

Continued rotation of the needle cylinder will bring the pattern jack 34 into a position adjacent a first bank 40*a* of pattern controlled selectors 38. It is within the patterning capacity of the equipment to project toward the needle cylinder any or none of the selectors 38 in the bank 40*a*. One of these selectors 38 will be at a level corresponding to the level of a tab 36 on the pattern jack 34. If that particular selector is in its extended position, the pattern jack 34 will be shifted, upon passage past the selector, to an inward position in its slot 30. Otherwise the pattern jack 34 will move beyond the selector bank 40*a* without having its outward position in the slot 30 disturbed in any way.

If the pattern jack 34 remains in its outer position, the cam follower tab 34*b* will upon continued rotation of the needle cylinder 4, ride up on the inclined cam surface 50*a* and the jack will be moved upwardly in its slot 30. As the jack moves upwardly in its slot, it presses against the positioning jack 32 to lift it, and the positioning jack in turn presses against the lower end of the needle 6 to raise the needle.

On the other hand, if the pattern jack 34 has been moved inwardly in its slot 30 by the action of a selector 38 in the selector bank 40*a*, the cam follower tab 34*b* thereof will be disposed radially inwardly of the cam 50 and the jack will pass the cam 50 while remaining in its lowered position.

Referring now to the cam means 42, it will be observed that the cam slot 44 for the needle butt 6*b* branches in the zone above the cam 50. A needle butt 6*b* which has not been raised by the action of the cam 50 on its pattern jack 34 will move along the lower of the two branch paths 44*a* and 44*b* upon continued rotation of the needle cylinder. However, the butt 6*b* of a needle which has been raised by the action of the cam 50 on its pattern jack 34 will be moved upwardly into a position to contact a cam surface leading into an upper branch path 44*a*.

After the needle butt 6*b* has entered the upper branch path 44*a*, the butt 32*b* of the positioning jack 32 contacts the downwardly inclined surface 52 of the cam means, and both the positioning jack 32 and the pattern jack 34 are returned to their lowered positions.

These branch paths 44*a* and 44*b* are disposed in the zone of doffer section 22*a* of the pile fiber feeding and carding head. The hook portion 6*a* of a needle whose butt follows the lower branch path 44*b* will pass beneath the doffer section 22*a* and will not take pile fibers therefrom. On the other hand, the hook portion 6*a* of a needle whose butt 6*b* follows the upper branch path 44*a* will be projected into the card clothing on the doffer section 22*a* and will take fibers for incorporation into the fabric being knitted.

While the needle butt 6*b* is moving along one or the other of the branch paths 44*a* or 44*b* of the cam slot 44, another pattern jack selection sequence begins. Another cam 48 is provided for acting upon the lower end portion of the pattern jack 34 to assure that the jack will be disposed outwardly in its slot 30 prior to movement of the jack past another selector bank 40*b*. Again, the positions of the selectors 38 determine whether the pattern jack 34 will be allowed to remain in its outward position or be pressed inwardly in its slot 30.

At about this time, the branch paths 44*a* and 44*b* are merged again. A needle butt which has been following the upper branch path 44*a* will be lowered as it is moved along a downwardly inclined cam surface 54. Hence, as each needle reaches this point, it is in its lower position and is in contact with the upper end of the lowered positioning jack 32.

As rotation of the needle cylinder continues, a new selective lifting sequence is carried out by another cam 50 and there is another branch in the needle butt cam slot 44. If the needle is raised by the action of the second cam 50, its butt 6*b* will follow an upper branch path 44*c* and its hook portion 6*a* will be projected into the card clothing on the doffer section 22*b* to take pile fibers therefrom. On the other hand, if the pattern jack 34 passes behind the second cam 50, the needle butt 6*b* will pass along a lower branch path 44*d* and the hook of the needle will not take pile fiber from the doffer section 22*b*.

Figure 4A:
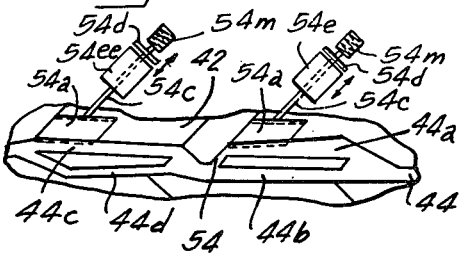
FIG. 4A is a fragmentary elevational schematic view showing additional means for controlling the positions of the knitting needles relative to the fiber supplying doffers at a representative one of the feed stations.
Figure 4B:
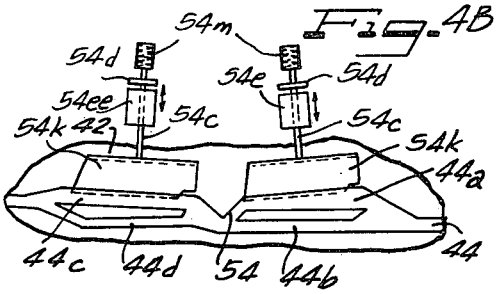
FIG. 4B is a similar elevational schematic view showing still further means for controlling the positions of the knitting needles relative to the fiber supplying doffers at a representative one of the feed stations.
Figure 4:
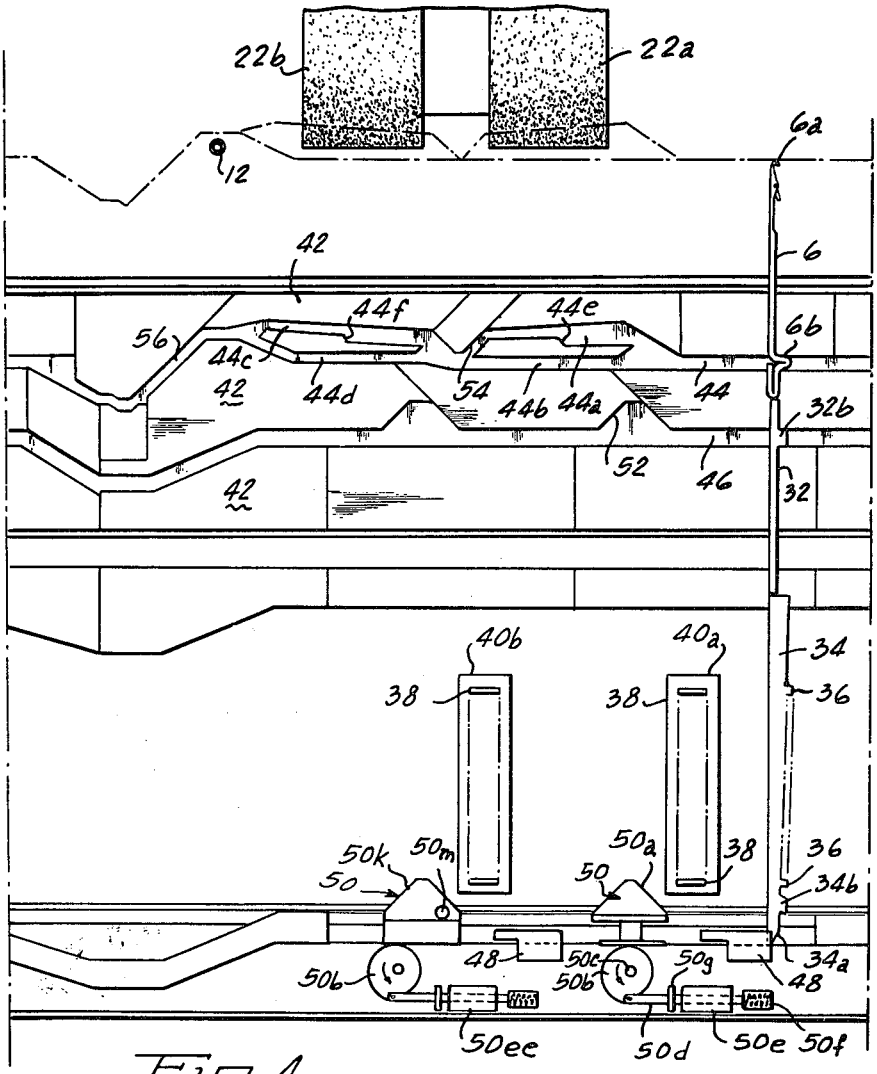
FIG. 4 is an elevational schematic layout of means for controlling the positions of the knitting needles relative to the fibersupplying doffers at a representative one of the feed stations.

The branch paths 44*c* and 44*d* of the cam slot 44 merge to the left in FIG. 4 in such a manner as to assure that the needle 6 will be in an elevated position as it is moved past the body yarn supply 12. Having picked up a body yarn 10 in its hook portion 6*a* at this point, the needle then is moved downwardly by a conventional stitch cam 56.

As the needle 6 is moved downwardly by the stitch cam 56, its hook portion 6*a* passes between adjacent ones of the sinkers 58 (FIG. 3) carried by a sinker ring 68 so that a loop portion of the newly suppled body yarn 10 will be drawn through a previously formed loop which rides up over the needle latch and is cast off. A sinker cap 62 and the other components associated with the sinkers 58 are conventional and they need not be described here in detail.

From the description given above, it will be evident that the needle selection system has virtually unlimited capacity for achieving pattern effect variations. In passing a given feed station A, B, etc., a needle 6 may pick up no pile fiber at all or it may pick up pile fiber from either or both of the slivers 26 and 28. Moreover, the pile fiber load acquired by a needle during any given pass by a feed station may be different from the pile fiber load acquired thereby during any other pass by that station. Pattern controlled actuation of the selectors 38 gives individual control over each needle raising operation, and even the most intricate of patterns are readily obtainable.

Such prior art systems also provide for regulation of sliver inputs to the various feed heads so that the fiber quantities supplied may be correlated with the fiber quantities required for the production of a desired pattern. In the illustrated embodiment, the sliver feed roll sets 14*a* and 14*b* of the various heads A, B, etc., are controlled by clutch systems shown in FIG. 5. This view shows the clutch drive system 15*b* for one of the sliver feed rolls 14*b*, and it will be understood that similar clutch drive systems are provided for at least one of the rolls of each of the feed roll pairs 14*a* and 14*b* in the machine. The other roll of each pair may be geared to the clutch driven roll or it may be weighted against the clutch driven roll so as to rotate therewith.

Figure 5:
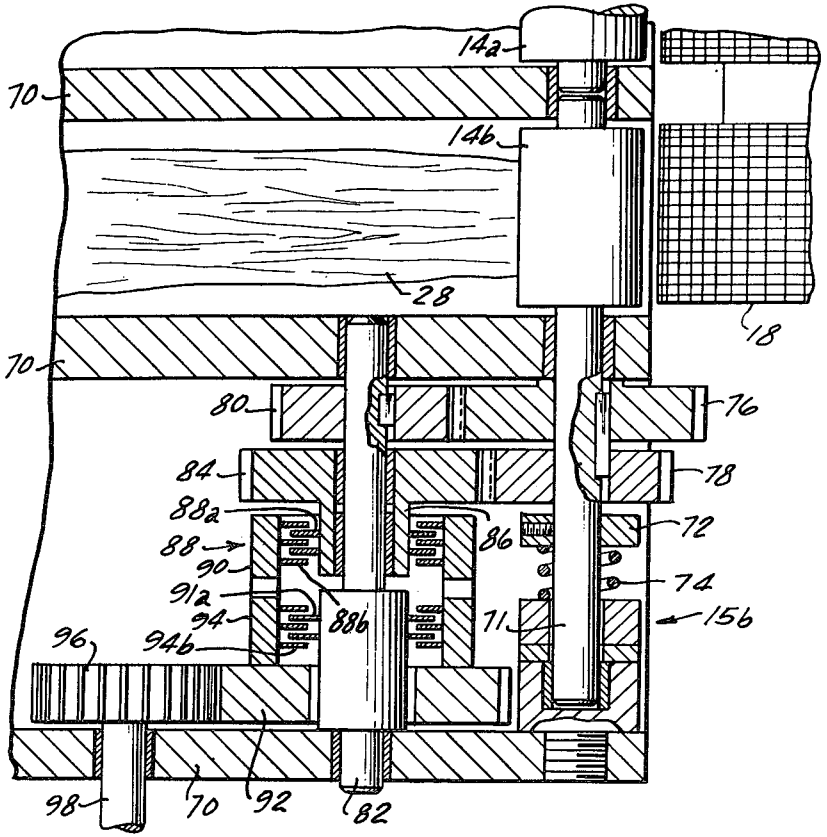
FIG. 5 is a cross-sectional view showing pile fiber feed rolls for one of the carding and feeding units and a clutching system for controlling the operation of such feed rolls.

As shown in FIG. 5, the rolls 14*a* and 14*b* at a given head A, B, etc., are journalled for independent rotation in frame means 70. An outwardly projecting shaft portion 71 of the roll 14*b* has a collar 72 fixed thereto, and a compression spring 74 bears against the collar 72 to impose a frictional drag on the shaft portion 71 inwardly to prevent slivers engaged by the wire clothing from moving feed roll 14*b*.

Also fixed to the outwardly projecting shaft portion 71 are a pair of gears 76 and 78 of different diameters. The gear 76 meshes with a gear 80 keyed to a parallel shaft 82, while the gear 78 meshes with a gear 84 mounted for free rotation on the shaft 82. This latter gear 84 has a sleeve 86 integral therewith which carries at 88*a* elements of a first electromagnetic clutch indicated diagrammatically at 88. Cooperating elements 88*b* of the clutch 88 are carried by a sleeve 90 fixed to a drive gear 92 journalled on an enlarged section of the shaft 82. A second electromagnetic clutch 94 includes elements 91*a* carried by the shaft 82 and elements 94*b* carried by the sleeve 90.

The gear 92 is driven continuously by a gear 96 fixed on a drive shaft 98 coupled to a power source (not shown). The rotational speed of the drive shaft 98 is coordinated with the rotational speed of the needle cylinder 4 and ordinarily it will be found convenient to provide a mechanical coupling system between these components. However, it will be understood that separate drives may be provided, if desired.

Each of the clutches 88 and 94 is of a known type requiring electrical energization in order to achieve coupling effect. In the absence of energization for the clutches, the sleeve 90 will rotate freely without exerting substantial drive effects on either the gear sleeve 86 or the shaft 82. When energizing current is supplied to the clutch 88, however, the sleeve 90 will be rotationally coupled to the gear sleeve 86 to drive the roll shaft 71 through the meshing gears 84 and 78. Energization of the clutch 94, on the other hand, couples the clutch sleeve 90 to the shaft 82 so as to activate the drive train which includes the gears 80 and 76.

The relative sizes of the gears of the two sets 76–80 and 78–84 are chosen to provide two distinctly different speed ratios between the roll shaft 71 and the drive shaft 98. Hence it will be seen that the arrangement depicted in FIG. 5 provides a capability for electrically selecting three different feed conditions for the pile fiber sliver 28 being handled by the feed rolls 14*b*. When neither clutch 88 nor clutch 94 is energized, the feed rolls 14*b* will be stationary, so that no fiber input will be provided to this particular feed line. Energization of the clutch 94, however, provides a relatively slow drive for the feed rolls 14*b*, so that modest amounts of fiber from the sliver 28 will be introduced into the feed line. Maximum input of fiber from the sliver 28 is achieved by energization of the clutch 88 which brings into play the high speed drive train. As will be apparent, one should not energize both of the clutches 88 and 94 simultaneously. If desired, the electrical circuits for the clutches may be so arranged as to positively prevent the inadvertent occurrence of such an event.

Figure 6:
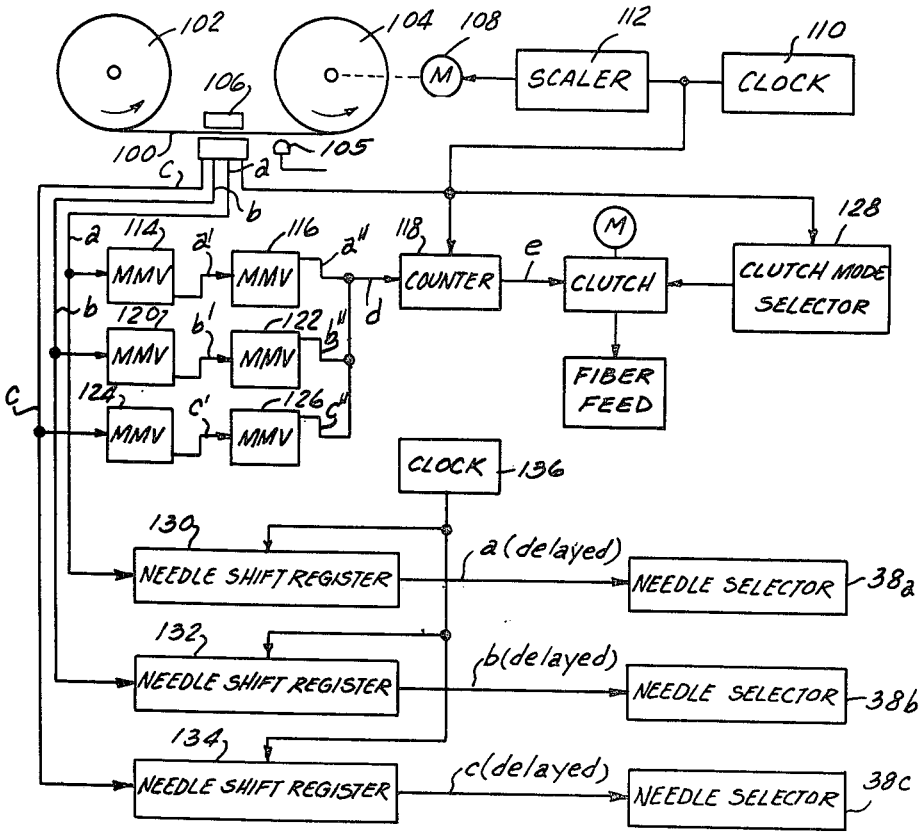
FIG. 6 is a diagram of a control system for the apparatus of FIGS. 1-5.

Coordinated control over the needle selection and feed clutch actuation may be provided by a system of the type illustrated in FIG. 6. In this view a pattern bearing tape 100 is shown extending from a supply reel 102 to a takeup reel 104. This tape may be a transparent tape having darkened areas selectively located, but other indicia such as holes or appendages may be employed if desired. Intelligence media other than tape may be used to bear the indicia if preferred. Moreover, magnetic tapes bearing suitable pattern coding are well known and may be used if desired. A scanner 106 is located intermediate the supply 102 and the takeup 104 to read the transversely extending rows of indicia as these rows move into position in the scanner. The tape is advanced incremently by a motor 108 which operates at intervals related to the rotational speed of the needle cylinder 4 of the machine.

In the illustrated system, control over the timing of the motor 108 is derived from a clock pulse generator 110. The basic time interval for the pulse generator 110 is equal to the time required for rotation of the needle cylinder 4 through an angle corresponding to the spacing of successive knitting needle slots 30 at the periphery of the needle cylinder. These pulses are fed to a scaler 112 which provides no output signal to the motor 108 until the accumulation of a predetermined number of pulses. Ordinarily it will be desirable to accumulate in the scaler 112 a number of pulses corresponding to the number of selectors 38 in each of the selector banks 40. With this arrangement the indicia bearing tape 100 will be indexed one unit for each time interval corresponding to the time required for movement past a given point of that number of needles which can be controlled by a single selector bank. In cases where the number of needles employed by the knitting machine is not a whole multiple of the pattern width (expressed in number of needles) it will, of course, be necessary to either program the tape accordingly or index the tape position to a reference point at the completion of needle cylinder rotation.

In the interest of simplicity of illustration, the showing in FIG. 6 deals with the control system for the needle selectors in a single selector bank and for a single fiber feed clutch. It will be understood, however, that all the other clutches and selectors may be similarly controlled from the tape 100 and that ordinarily this will be done in order to minimize the probability of problems arising through lack of coordination between the control signals on separately operated tapes.

Figure 8:
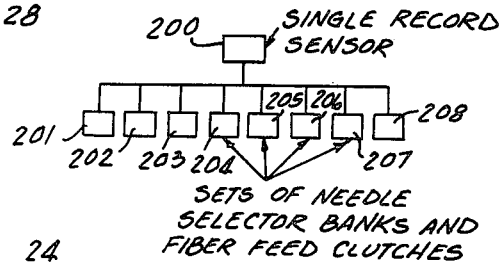
FIG. 8 is a diagram showing the use of a single control for a plurality of pile fiber supplies.

Such a system is shown in FIG. 8 where the block 200 indicates a sensor on a single indicia bearing medium, such as a tape, and where the blocks 201, 202, 203, 204, 205, 206, 207 and 208 indicate the respective sets of needle selector banks and fiber feed clutches disposed about the periphery of the machine.

The scanner 106 provides separate output channels for each of the needle selectors being controlled thereby. In FIG. 6 only three of these have been shown in the interest of simplicity. When a needle is to be selected for elevation into contact with a particular doffer element of a pile fiber feeding line, the appropriate signal channel *a, b, c,* receives a signal from the scanner 106 to this effect. Such signal also is utilized to condition the clutch for the feed rolls of that particular pile fiber line so as to cause one increment of pile fiber input to that line. The system also includes means for adjusting the time interval between clutch actuation and needle selection so that the fiber feed may be initiated somewhat in advance of the fiber utilization, if desired.

These various relationships may best be explained by way of an example. In this instance, it will be assumed that a given index operation of the tape 100 has placed in the scanner 106 a tape portion which signals to channel *a* that needle selector 38*a* is to be extended, which signals to channel *b* that needle selector 38*b* is to remain in its retracted position, and which signals to channel *c* that needle selector 38*c* is to be extended.

Referring to channel *a,* it will be seen that the signal there is coupled to a monostable or one-shot multivibrator 114. The leading edge of the pulse from the scanner 106 sets the multivibrator 114 to produce a square wave having a predetermined duration. An output signal at one terminal of the multivibrator 114 is produced concurrently with the trailing edge of this square wave, and such signal triggers a second similar monostable multivibrator 116. An output signal from the multivibrator 116 serves to advance a counter 118 by one unit.

Similar monostable multivibrator pairs 120–122 and 124–126 are provided for channels *b* and *c*. However, the multivibrators 114, 120 and 124 have different time constants and this produces square waves of different durations. Since the trailing edges of the square wave output signals from these units effectively activate the second multivibrators in the various channels, the pulses from these second multivibrators 116, 122 and 126 will arrive at the counter 118 as separate signals so that they may be accumulated there as discrete units. In the stated example, there will be no output from the multivibrator pair in channel *b* but there will be a second output from the multivibrator in channel *c*. Hence, the counter 118 will receive two units of advance on the occasion of this particular reading by the scanner 106.

The clock pulse generator 110 also is coupled to the counter 118. This coupling serves to count down whatever signal is delivered to the counter in regularly timed increments. The output signal from the counter 118 is connected to the fiber feed clutch in such a fashion that one or the other of the two clutch coils will be energized as long as there is any signal in the counter. Hence, in the example, the clutch will operate for two units of time and will advance into the fiber feed line a corresponding quantity of pile fibers.

Another channel from the scanner 106 controls a clutch mode selector 128 that determines which one of the two clutch coils on the clutch will be activated during this cycle.

Returning to channels *a, b* and *c,* it will be observed that these also lead to shift registers 130, 132 and 134. The shift registers are clocked by a clock pulse generator 136 and may be adjusted to provide a variable delay between the appearance of a signal at the input terminal of a shift register and the appearance of a corresponding output signal therefrom. Frequently it will be found desirable to utilize such a delay in order that an increment of fiber input may be correlated more closely with an increment of fiber utilization. That is to say, there is a real time interval between the supply of pile fibers to the feed rolls of a fiber feeding and carding unit and the utilization of that particular increment of pile fibers by the knitting needles, and this interval may be taken into account by appropriate regulation of the shift registers 130, 132 and 134.

Figure 7:
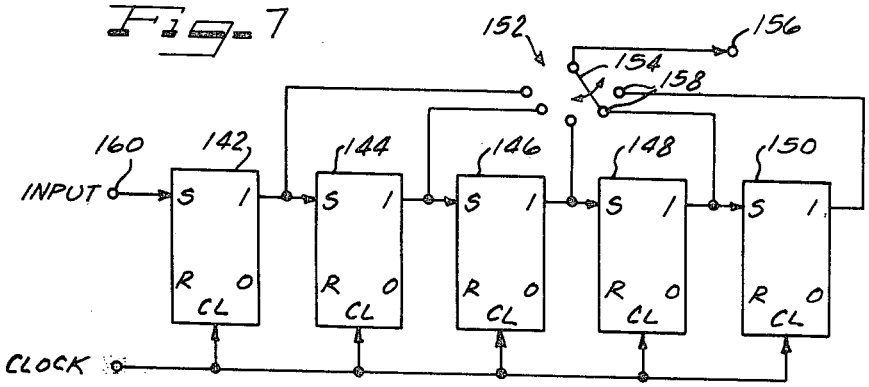
FIG. 7 is a diagram illustrating one of the components of the control system of FIG. 6.

FIG. 7 shows one form of shift register unit which may be employed if desired. In this view, a plurality of binary elements or flip-flops 142–150 are shown serially connected in a manner such that a high level signal applied to the set input terminal S of any one of the flip-flops upon receipt of a clock signal applied to the clock input terminal CL will provide a high signal level on the binary "1" output therminal thereof. This high level signal is applied to the set input terminal S of the immediately subsequent flip-flop which, when clocked, will be operative to provide a high level signal on the set input terminal S of the next flip-flop. In this fashion, a binary "1" introduced into the first flip-flop 142, will be successively walked through the chain of binary elements in the shift register by the application of clock pulses.

The number of binary elements in the shift register may be varied as desired. Since the time interval between successive clock pulses has been predetermined, the length of time for an input signal to walk through the register is a function of the number of binary elements in the register.

For ease in varying the effective number of binary elements in the register, and thus the time interval, a switch 152 is provided having a rotary arm 154 connected at one end to an output terminal 156 and selectively rotatable into contact with one of a plurality of terminals 158. Each of these terminals 158 may be connected to receive the output signal from the binary "1" output terminal of one of the binary elements in the register. In the switch position illustrated in FIG. 7, the time delay between the application of a pulse to the input termianl 160 and the appearance thereof at the output terminal 156 is a function of the time required to walk the signal through the binary elements 142–148 to the terminal 156, a time interval of four clock pulses.

The output signals from the several shift registers 130, 132 and 134 are individually coupled to needle selector means 38*a,* 38*b* and 38*c* to control the reciprocation of selected needles into contact with the doffer section of the fiber feed line controlled by the signal channels *a, b* and *c.* In this example, selector means 38*a* and 38*c* will be conditioned to cause needles to reciprocate and selector 38*b* will be conditioned to allow a needle to move passively by the fiber feed line without taking pile fiber therefrom.

As thus far described, the illustrated system, constructed in accordance with the prior art, provides close correlation between fiber input and fiber utilization. Unless needles are programmed to be raised into contact with the doffer surface of a particular fiber feed line, the feed rolls for that line do not supply fiber. This correlation between fiber input and fiber utilization is particularly significant in connection with the production of patterns in which there are substantial variations in the intervals between needles which must take fiber from a particular feed line. In such instances the use of a constant fiber input rate tends to produce undesired accumulation of fiber in the feeding and carding line during the intervals when no needles are removing fiber and/or to supply inadequate quantities of fibers to larger groups of selected needles. The tape control system also is ideally suited for the production of intricate patterns. Although in many instances the desired pattern may be coded into a tape short enough to permit of its being handled mechanically as a single endless band containing a pattern "repeat", more complex patterns can be obtained through the use of supply and wind-up reels as illustrated.

While the knitting machine apparatus of the prior art, as just described, is vastly superior to systems prior thereto, use of such knitting machines has uncovered occasional situations in which needle overload occurs. Complex patterns which were never before possible have been successfully knitted, and have caused attempts at even more sophisticated patterns. When extremely complicated patterns are attempted with such prior art knitting machines, we have found that the response to the fiber feed control thus far described is insufficiently rapid to prevent occasional fiber build-up on the doffer, or to meet all requirements for needle load control, such as to reduce or to increase the needle load. Any substantial fiber build-up may cause a situation in which the individual needle introduced into the doffer will pick up an excess, or clump, of fibers. The result of such occasional overloading of the needles may result in an unevenness in the knitted material where uniformity is a requirement. On the other hand it may be desirable to effect pattern variations by controlling i.e. modulating or regulating, the quantity of pile fibers transferred by the knitting needles to the knitted fabric, where the fiber supply on the doffers remain uniform.

In accordance with the present invention, we have provided means for dynamically controlling and regulating the fiber load picked up by individual needles as they pass a given fiber zone such as defined at least in part by a feeding means such as a doffer during continuous operation of the knitting machine. The precise cooperation between a given needle and a fiber zone is important, particularly during the interval in which the needles are reciprocated to reach into the fiber zone to pick up a load of fibers and incorporate them into the fabric as it is being knit by the needles acting upon the backing yarn. Relatively small variations in needle position, in terms of angle of approach and/or depth of penetration cause a substantial variation in effectiveness of the needle in pickup of fibers from the fiber zone. Additionally, the actual distance that a needle travels through the fiber zone, such as may be defined at least in part by the surface of a doffer will also vary the amount of fibers picked up. In accordance with this invention, we have provided means for dynamically affecting these relationships in a knitting machine so that the fiber pick-up or fiber load by the needles may be almost instantly controlled, either automatically or manually. This control may effectively be employed with knitting machines of the type described in Beucus U.S. Pat. Nos. 3,413,823 and/or 3,709,002 above described.

A more complete understanding of our controllable means for regulating the quantity of pile fibers transferred by the knitting needles from the respective ones of the fiber feeding zones to the knitted fabric, as applied to a system such as the above may be had from a further consideration of the drawings. Attention is first drawn to FIG. 4 wherein, as above discussed, the individual needles 6 are inserted into the doffers 22*a*, 22*b*, a depth indicated generally by the dot-dash line 6*a*. The depth of this penetration is controlled by the cams 50, more particularly identified as 50*a* and 50*k* which, upon contact with the pattern jacks 34 move positioning jacks 32 upwardly causing the needle butts 6*b* to take the upper branch path 44*a*, 44*c*. In the system thus far described, the needle 6 is in contact with the clothing of the doffer 22*a* throughout the width of the doffer. In accordance with out invention, the needle 6 may, under a refined control, be raised into the clothing of the doffer 22*a* a shorter than usual distance by adjusting the cam 50*a* downwardly a slight amount. This may be accomplished by any mechanical means such as for example by an eccentric cam 50*b* rotatable on pivot 50*c* and rotated in a counterclockwise direction by connecting rod 50*d* actuated toward the right as viewed in FIG. 4 by means of a solenoid 50*e* against a spring 50*f*. A shoulder 50*g* provides a fixed distance of actuation of the connecting rod 50*d* with, accordingly, a fixed downward movement of cam surface 50*a*. Thus, upon energization of solenoid 50*e*, needle 6 will be raised in a corresponding amount slightly less than its usual travel. Since, as described above, needles 6 and their related drive components are frictionally held in their slots to stay in the position to which they are urged, the individual needle butts 6*b* will travel across branch path 44*a* out of contact with the uppermost cam surface thereof and at a position along the lower surface defining the path in which the needle head 6*a* is just shy of entering the clothing of the doffer 22*a* for fiber pickup. After the needle has travelled a predetermined distance without picking up fiber from the doffers, the needle butt 6*b* encounters a raising cam edge 44*e* which causes the needle to be shifted upwardly into fiber pickup relation in the doffer clothing for the remainder of travel through the path 44*a* to pick up a limit quantity of fibers. To accommodate this construction, the width of the branch path 44*a* is made sufficiently large to accommodate positioning of the needle butt 6*b* against the upper edge of the track, or initially adjacent the lower edge thereof.

As above described, the cam 50*a* is reciprocal above cam 50*b*. Alternatively, the cam 50*a* may be pivotally mounted as, for example, illustrated in connection with the cam 50*k* associated with control of the needles cooperating with doffer 22*b*. As there illustrated, the cam 50*k* is pivotally carried on pin 50*m* and seats on eccentric 50*b* operable in substantially the same manner as described with respect to actuation of cam 50*a*. Upon controllably lowering of the cam 50*k* the needle butt 6*b* travels along the lower surface defining the path 44*c* wherein, as shown, during the first interval of travel the needle head 6*a* remains out of fiber receiving contact with the clothing of the doffer 22*b* until it encounters an upraising cam surface 44*f* which drives the needle head into the doffer clothing to receive fiber.

While insertion of the heads 6*a* of the needles 6 into the doffers 22*a*, 22*b* may be effectively reduced in accordance with the above described structure of FIG. 4, other means may alternatively be provided for reducing the amount of time that a given needle is exposed to an individual doffer, or the depth to which any selected needle may enter the doffer clothing. Thus, as may be seen from FIG. 4A, either or both of the branch paths 44*a* and 44*c* may be provided with a downwardly slidable cam 54*a*, actuated by a reciprocal armature plunger 54*c* driven downwardly by actuator motor means such as a solenoid 54*e* and normally spring-biased upwardly by spring 54*m* and controlled in downward movement by stop 54*d*. Actuation of the solenoid 54*e* causes movement of the respective cam 54*a* downwardly into the dotted line position in which it intercepts needle butts 6*b* causing them to retract the needles 6 from the doffers 22*a*, 22*b* after a travel of the needles through only a portion of the doffer clothing. The amount of movement of the cam 54*e* may be a relatively small amount, or any, if desired, be sufficient to provide complete withdrawal in the manner of cam 54.

For some purposes it may be desirable to effect needle head depth control in respect to the doffer clothing throughout the fiber-gathering sweep or pick-up across the face of the particular doffer, and for this purpose, the arrangement illustrated in FIG. 4B will be useful. Therein, in respect to either or both of the branch paths 44*a* and 44*c*, a vertically reciprocably shiftable cam 54*k* is provided which is mounted across the top of the respective channel path 44*a*, 44*c* to provide for maximum needle head penetration of the respective doffer clothing when the cam is in the uppermost solid line position shown, but which will modulate the fiber pickup by controlling the depth of penetration of the selected needle or needles by downward shifting of the cam 54*k* to the desired extent under the control of a solenoid 54*e*, the armature of which is normally biased as by means of a spring 54*m* to the upper most or normal needle penetration depth position.

It will be apparent to those skilled in the art that a plurality of cam 54*a* or 54*k* may be used in series relative to a given doffer to provide selective points of withdrawal from the doffer. In such cases a motor or actuator such as a hydraulic or pneumatic device or solenoid is employed for each cam in the series.

Figure 3:
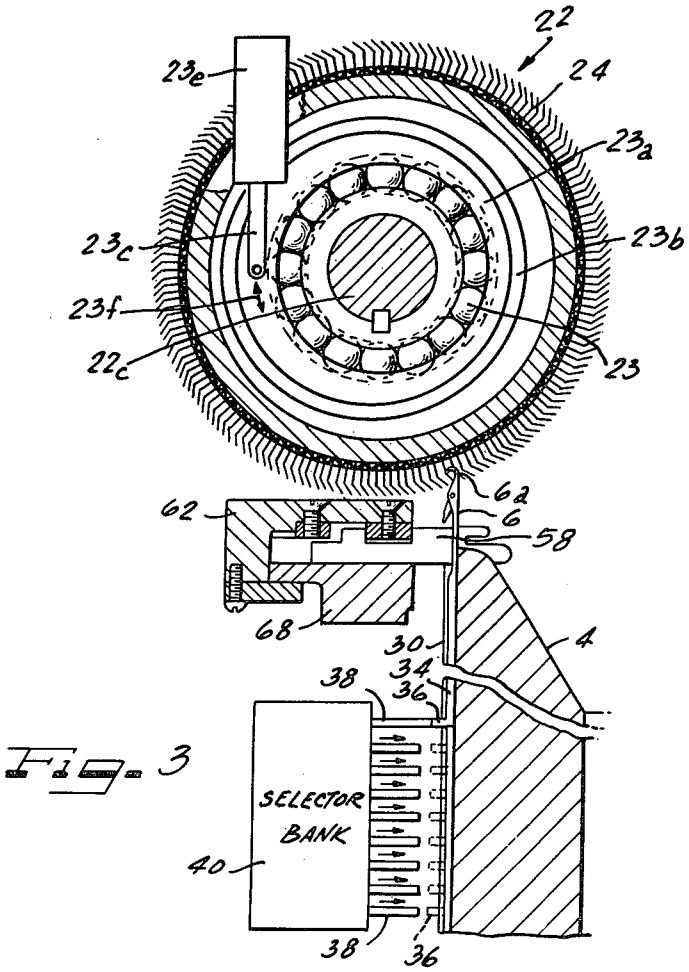
FIG. 3 is an enlarged vertical cross-sectional view through a portion of the needle cylinder of the apparatus of FIG. 1, illustrating the operative relationship between a knitting needle and the doffer of one of the pile fiber carding and feeding units, and illustrating diagrammatically a needle selection arrangement according to the present invention.

Additional control means for regulating the relationship of the individual needles 6 with the doffers 22*a*, 22*b*, may be understood from a consideration of FIG. 3. As there shown, the doffer 22 is illustrated as supported for rotation in a ball bearing 23 having an outer race 23*a* in the form of an eccentric. The eccentric race 23*a* is supported in fixed housing 23*b* for rotation by means of a rod or link 23*c* driven by a suitable actuator motor such as a solenoid 23*e*. With the arrangement illustrated, axial shifting of the link 23*c* will cause generally vertical shifting of the axis of rotation of the doffer 22 in the directions of arrow 23*f*. Such shifting will effectively vary the amount of penetration of the needles into the doffer cloth, with an increasing amount of pick-up by each needle hook portion 6*a* occurring as the doffer 24 moves downwardly as viewed in FIG. 3. This arrangement is particularly adaptable to the alignment of the rolls as shown schematically in FIG. 12. If, however the roll alignment of FIG. 2 is used, the eccentric 23*a* may change by an angle of about 90° out of phase with the position illustrated in FIG. 3 to provide horizontal oscillation of the doffer upon energization of the actuator 23*e*. In either instance the doffer will not vary significantly its relative position with respect to intermediate card wheel 24, so that variation in position of the doffer 22 will not affect the feed of fibers to the doffer but only the pick-up of fibers by the needles 6a. Such an arrangement provides for engagement of the needles into the doffer clothing by translation of the doffer 22 relative to the needles under the control of the motor 23e, as an alternative to control of penetration of the needles into the doffer clothing as described above with respect to cam arrangements of FIGS. 4, 4A and 4B.

Figure 10:
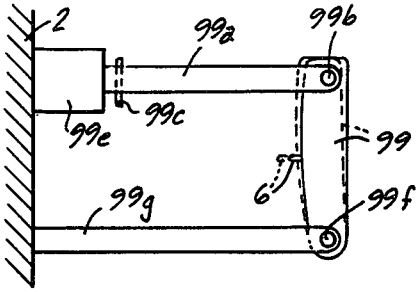
FIG. 10 is a partial plan view of the control illustrated in FIG. 9.
Figure 9:
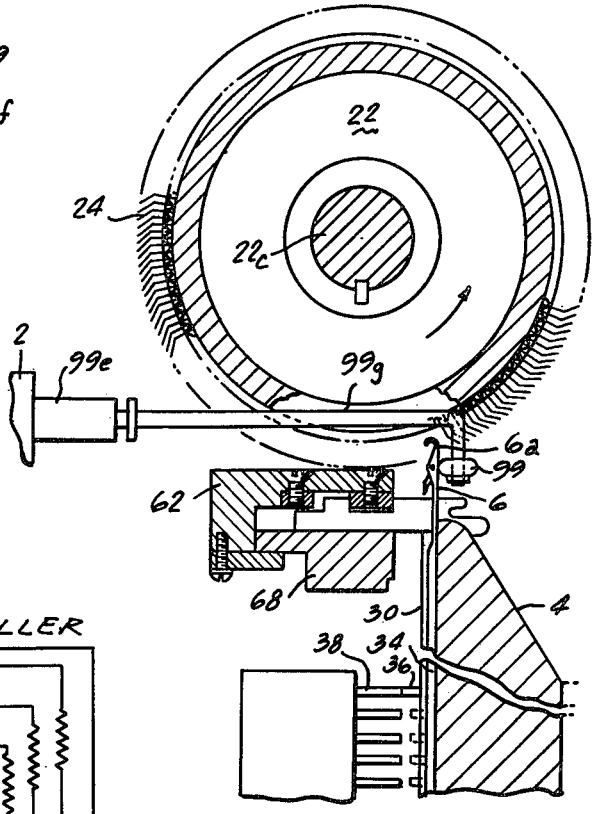
FIG. 9 is a view similar to FIG. 3 illustrating an additional embodiment of needle control.

The angle of introduction of the individual needles 6a into the cloth of the doffer 22 may also be provided in a manner illustrated in FIG. 9 and 10. There, the needles 6 are influenced by means of a radially outwardly shiftable deflecting cam 99 which is movable into the dotted line position shown in FIG. 10 by way of a connecting rod 99a pivotally connected thereto at 99b and reciprocal against stop 99c by means such as a solenoid 99e. The deflector cam 99 is supported by a pivot 99f on fixed support member 99g which, along with motor 99e is rigidly mounted to the base of the machine so that cam 99 is fixed relative to the individual doffer 22. Oscillation of the cam 99 by solenoid motor 99e will cause deflection of the needle 6 in the left-hand direction as viewed in FIG. 9 causing an angle of attack variation on the doffer 22 making the hooks 6a of the needles slightly less receptive to fiber pick-up and resulting in a decrease in pickup.

Figure 12:
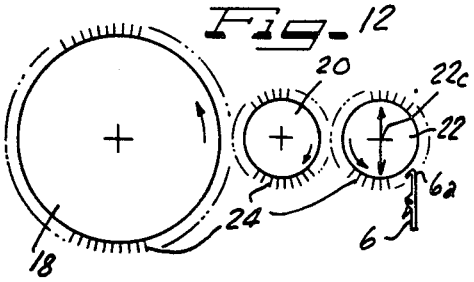
FIG. 12 is a schematic illustration of means of controlling fiber pick-up by the needles through shifting of the doffer roll.

Other means for regulating the quantity of pile fibers transferred by the knitting needles from any one of the fiber zones, as illustrated in FIG. 12, comprise mounting the respective doffer roll 22 for vertical movement, as indicated by directional arrow, to thereby vary the depth to which the needle hook portion 6a can thrust into the clothing 24 on reaching for a load of fiber from the doffer under the control of the pattern means. For this purpose, the doffer 22 in each instance will have its axle or shaft 22c mounted in a manner to enable the desired vertical upward or downward shifting of the doffer. Of course, such shifting will be of a low magnitude so that the fiber transfer relationship of the doffer 22 to the intermediate roll 20 remains virtually the same. Any suitable actuating means for effecting the desired movement of the doffer may be utilized, such as solenoid, magnetic clutch, pneumatic or hydraulic actuator, etc.

Figure 13:
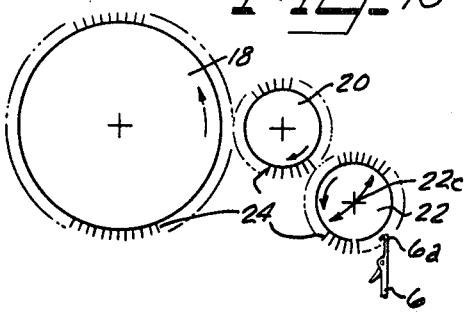
FIG. 13 is a schematic illustration of means for controlling fiber pick-up by the needles through a slightly different mode of shifting the doffer roll.

In FIG. 13, a modified arrangement is depicted for shifting the doffer 22 relative to the needle path to regulate the volume of fibers grasped by the needle head 6a by varying both depth of engagement and angle of engagement of needles with doffer clothing. This comprises shifting the doffer, as indicated by directional arrow, in an arc which may or may not be concentric with the axis of the intermediate roll 20 as preferred, thereby maintaining a substantially constant fiber transfer relationship between the clothing 24 of the doffer and the intermediate roll and varying only the fiber transfer relationship, from the to the needles as preferred. In this instance, similarly as in FIG. 12, the axle of shaft 22c of the respective doffer 22 may be mounted in the vicinity of the axis of intermediate roll 20 to enable the slight arcuate shifting of the doffer 22.

Figure 14:
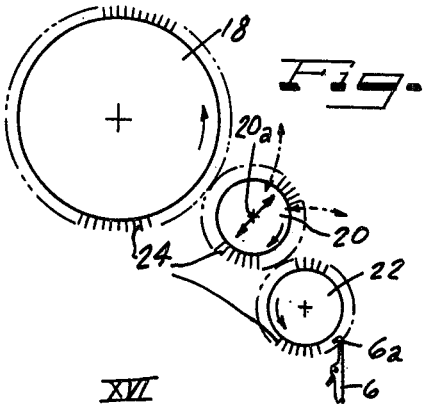
FIG. 14 is a schematic illustration of means for controlling fiber pick-up by the needles through shifting the intermediate transfer roll.

As represented in FIG. 14, regulation of the quantity of fibers transferred by the knitting needles from the respective doffer 22 to the knitted fabric may be effected by means comprising shifting the intermediate roll relative to either or both the supply roll 18 and the doffer 22. For this purpose, the intermediate roll 20 has its axle or shaft 20a mounted in a manner to enable shifting of the roll 20 by any suitable control means transversely to its axis and thereby transversely to the axis of the rolls 18 and 22. For example, as indicated by the solid straight directional arrow, the intermediate roll 20 may be shiftable transversely reciprocably to move its cloth perimeter 24 closer or farther from the cloth perimeters 24 of the rolls 18 and 22 to thereby control the amount of fiber transferred to the doffer 22 and thereby the amount of fiber that each of the needles will gather from the doffer under pattern control. By moving the roll 20 closer to the associated rolls a denser application of fiber to the doffer is effected while moving the intermediate roll away from its companion rolls a desired scant applicaton of fibers to the doffer takes place. On the other hand, the intermediate roll 20 may be mounted to move in an arcuate relative adjustment path as indicated, for example, by the dot-dash directional arrow wherein the intermediate roll is shifted on a radius in the vicinity of the axis of the supply roll 18, thereby maintaining transfer relation to the supply roll but varying the transfer relationship of the intermediate roll to the doffer. Alternatively the intermediate roll 20 may be shifted as indicated by the directional dashed arrow on a radius in the vicinity of the doffer axis, thereby maintaining fiber transfer relation to the doffer 22 but varying the transfer relation of the intermediate roll to the supply roll 18. In either instance, the transfer of fibers to the cloth perimeter of the doffer 22 is regulated and thus the quantity of fiber that will be received from the doffer by each needle will be regulated.

Figure 15:
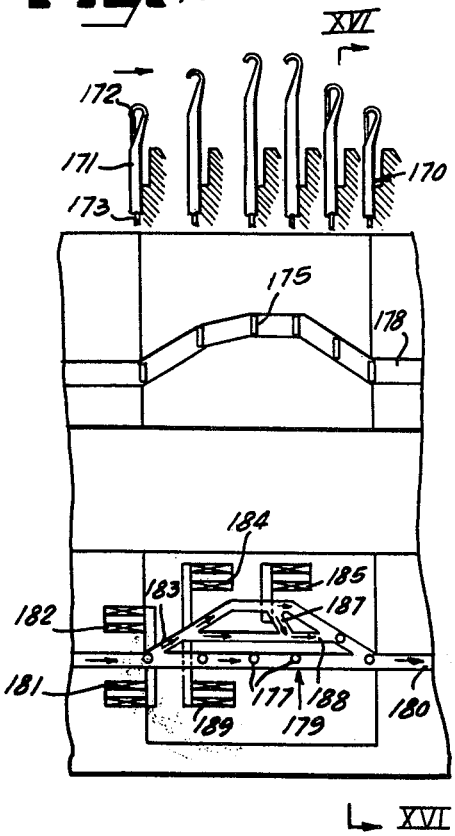
FIG. 15 is a fragmentary developed schematic illustration of means including electromagnets for controlling needle fiber pick-up.
Figure 16:
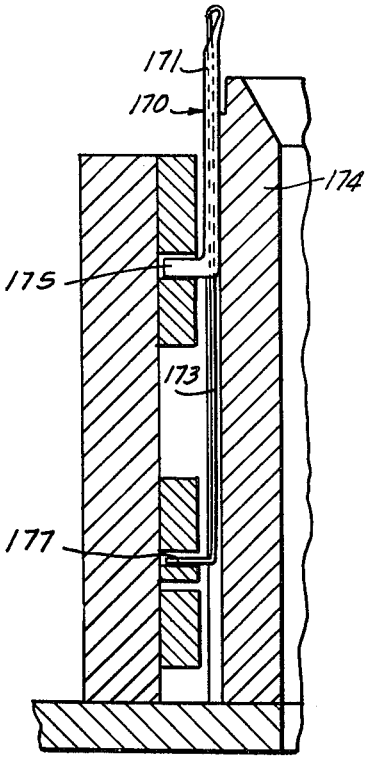
FIG. 16 is a vertical sectional detail view taken substantiallt along the line XVI—XVI of FIG. 15.

In FIGS. 15 and 16 is shown an arrangement wherein knitting needles of the slide latch type are controlled for regulating the quantity of pile fibers transferred by the knitting needles from the respective ones of the fiber feeding zones to the knitted fabric. An example of such needles is found in Schmidt U.S. Pat. No. 3,426,550 the disclosure of which is incorporated herein by reference to any extent necessary. Therein slide latch needles 170 each comprising a tubular shaft 171 having a hook 172 has a latch element 173 extending axially therethrough for controlling opening and closing of the hook. The needles 170 are mounted in a needle cylinder 174 and have respective butts 175 on the hook elements 171 and butt portions 177 on the lower ends of the latch elements 173. Knitting reciprocations of the hook elements 171 is effected by riding of the butts 175 in a cam track 178. In this instance, pattern control of the needles is effected by opening and closing the hooks 172 by shifting of the slide latches 173 between open and closed position. According to the present invention the degree to which the latches 173 are opened during a fiber gathering pass into any selected one of the supply means fiber zones of the machine effects regulation of the quantity of fibers gathered by any given of the needles 170. For this purpose, a cam track arrangement 179 for the latch butts 177 is provided wherein when the needles are to function to secure a full or normal load of fibers from the selected fiber zone, the latch butts 177 are constrained to run along a horizontal open latch track groove 180, an electromagnet 181 being provided for this purpose to bias the latch butts along the continuous lower edge of the track groove. If in passing the doffer the pattern control does not call for fibers from that particular fiber zone, an electromagnet 182 is activated which shunts the latch butts 177 into a closed latch cam groove 183. As the latch butts advance into the cam groove 183, and the pattern control indicates that there should be no fiber taken from the fiber zone by a particular needle, an electromagnet 184 continues the particular latch butt 177 on through the remainder of the closed latch control cam groove and the affected needle will take on no fiber because its hook 172 will remain closed throughout the pass through the fiber zone, i.e. across the face of a doffer. If, instead, the pattern does call for fiber to be transferred by any given needle into the knitted fabric, but control means according to the present invention indicate that there is more fiber or a greater thickness or a pile up of fiber along the doffer just as the given needle makes its pass to gather fiber from the doffer so that if a fully opened gathering pass were made by the needle an excessive quantity of fiber would be captured by the needle hook 172, means for controlling the degree to which the particular latch 173 closes the hook come into operation to thereby regulate the quantity of fiber to be accepted by the needle from the excessive volume on the doffer so as to be the proper required amount for the pattern. Thus, if the doffer carried fiber load is excessively heavy, the needle hook may be opened to only a minimum and still receive a sufficient quantity of fiber. For this purpose the affected latch butt 177 is diverted from the fully needle closing position to a partially opened position before the needle has completed its doffer pass, by action of a control electromagnet 185 which causes the latch butt to be diverted in a downwardly directed cam groove shunt 187 into a horizontal partially opened control groove portion 188 above and, as shown, parallel with the groove 180 and connecting the upward and downward leg portions of the control groove 183. Thereby after the needle head 172 has traveled along the doffer face in fully closed position for a short interval, the latch 173 is partially opened for the balance of the interval of the fiber gathering pass of the needle. Should the associated detecting means observe that there is only a minor adjustment needed in the fiber gathering ability of any particular needle at any given time interval of pass across the face of the doffer, the electromagnet 182 first shunts the latch butt 177 of that needle into the groove 183, and then an electromagnet 189 diverts the affected latch butt into the intermediate latch open control groove 188 to travel therealong throughout the pass of its needle across the face of the doffer with the hook 172 partially opened, and thereby regulating the quantity of fibers gathered by the partially opened hook. It will therefore be apparent that in the arrangement of FIGS. 15 and 16 a plurality of control parameters are provided simply, efficiently and adapted for high speed operation.

Figure 17:
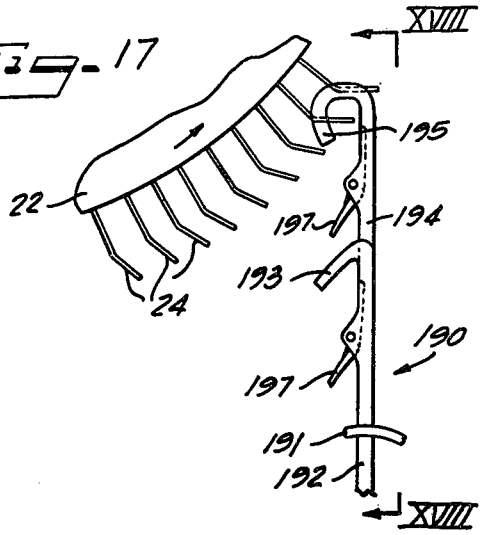
FIG. 17 is a schematic inside elevational view of companion needle means for controlling fiber pickup.
Figure 18:
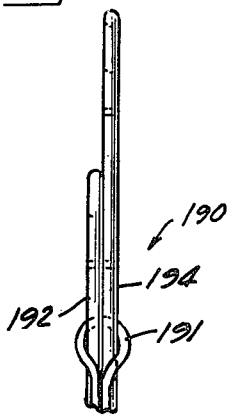
FIG. 18 is an elevational view of the needles taken substantially along the line XVIII—XVIII in FIG. 17.

In still another arrangement as illustrated in FIGS. 17 and 18, companion needles 190 of different size and shape and operating in a common slot in the needle cylinder and working in a common loop 191 in the fabric are provided. Each pair of the needles 190 comprises a needle element 192 having a head 193 shaped with a maximum open hook, and a needle element 194 having a head 195 providing a hook partially closed to receive a minimum quantity of fibers therein, assuming the fiber load on the associated doffer 22 is uniform. The needles 192 and 194 are in side by side slidable relation and each has a respective pivoted latch 197 as is customary. Any suitable controlable means such as selector cams, grooves, electromagnetic actuators, and the like, are provided for regulating the cooperation of the needles 192 and 194 with respective ones of the fiber zones to control the quantity of fibers picked up by the needles from the respective ones of the zones to the knitted fabric. The controlable means raise either of the two needles 192 and 194 or both together to transfer varying amounts of fiber according to pattern information or pattern means and to regulate the quantity of fibers gathered from the doffer by the needle assembly as determined by the fiber load on the doffer at any given time. Thus, when the indication is that the maximum load of fibers is to be received from the doffer in a needle pass, the needle element 192 is actuated to receive the fibers from the doffer and the needle 194 may remain free or depressed, although in this instance both of the needle elements may be simultaneously actuated into fiber receiving position. Should the control means call for a minimum or smaller quantity of fibers than the needle element 192 can gather, because of pattern requirements, or because associated control means have detected excessive fibers on the doffer, only the needle element 194 will be raised to gather fibers from the doffer 22. However, the arrangement is such that both of the heads 193 and 195 of the needle elements are simultaneously engaged with the body yarn and act in unison to pull it through and cast off the previous loop 191 in each knitting actuation of the needle assembly 190.

Figure 19:
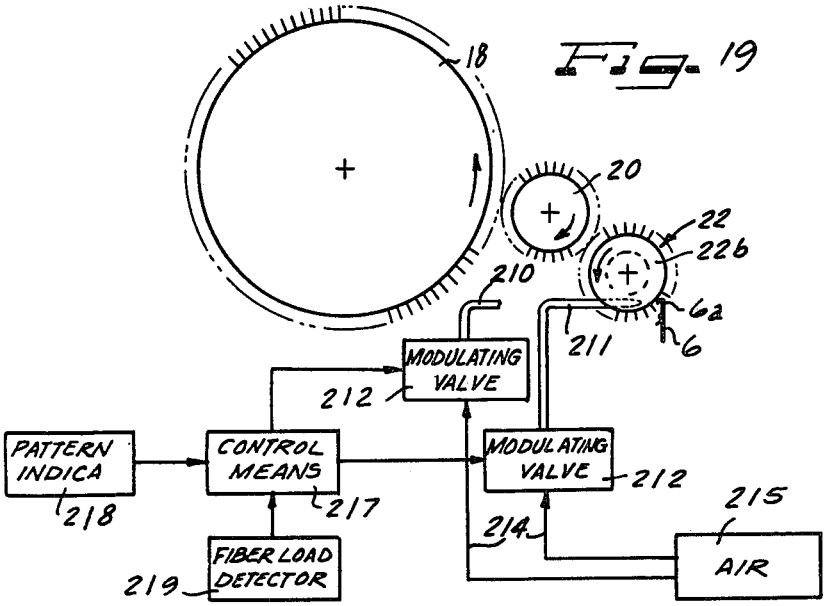
FIG. 19 is a side elevational schematic view of means for controlling the fiber pick-up by the needles comprising air nozzles.
Figure 20:
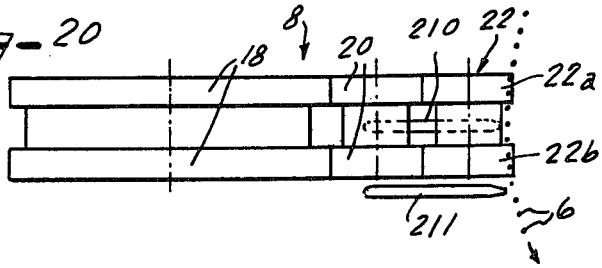
FIG. 20 is a top plan view of FIG. 19.
Figure 21:
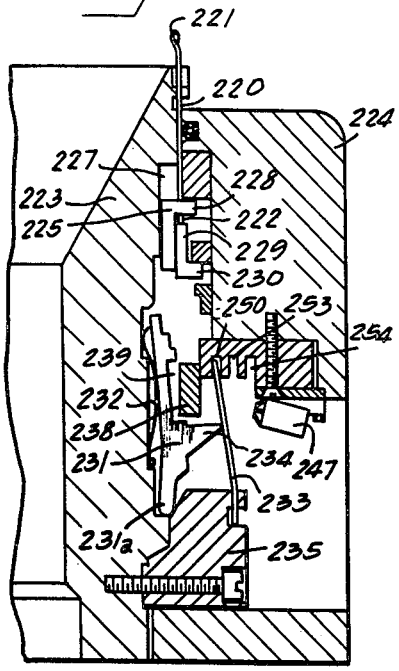
FIG. 21 is a vertical sectional detail view of another modification involving a sliding latch needle arrangement.
Figure 22:
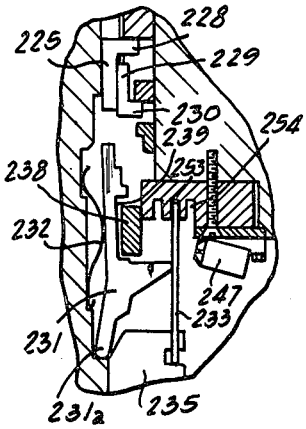
FIG. 22 is a fragmentary sectional view showing the parts of FIG. 21 in a different operating attitude.
Figure 23:
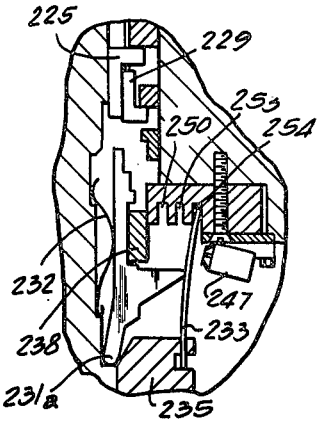
FIG. 23 is a similar fragmentary sectional view showing the parts in still another operating attitude.
Figure 24:
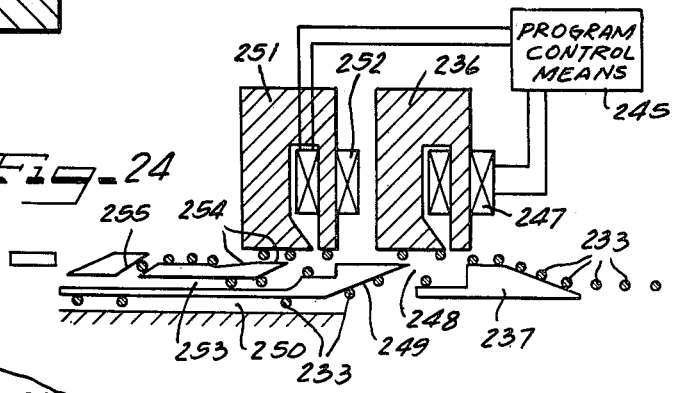
FIG. 24 is a schematic illustration of means for controlling the spring rods of the device of FIG. 21.
Figure 25:
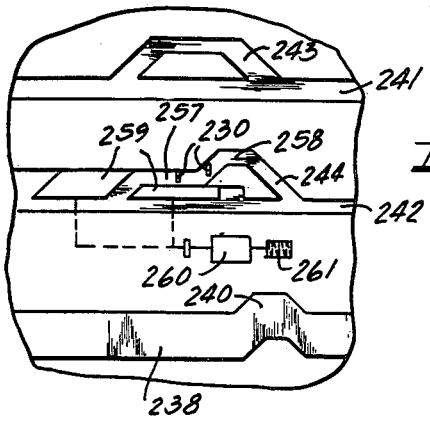
FIG. 25 is a schematic control cam means for the device of FIG. 21.

Having reference to FIGS. 19 and 20, controllable means for regulating the quantity of pile fibers transferred by the knitting needles from the respective ones of the fiber zones to the kitted fabric comprise means for partially removing fibers from any selected needle after the needle has gathered the fibers from a selected doffer. Such partial removal of fibers may be for any desired purpose such as to vary the fabric pattern as determined by suitable control means or in order to maintain uniformity in the pattern by diminishing excessive quantities of fibers gathered by any particular needle. For example, in an arrangement as represented herein wherein each carding and feeding unit 8 includes a pair of main drum members 18 for supplying respective colors and associated transfer or intermediate drum members 20 delivering to doffer rolls **22*a* and 22*b*, respective fiber quantity control means in the form of air jet nozzles 210 and 211 may be provided. The nozzles 210 and 211 are located adjacent to the downstream sides of the doffers 22*a* and 22*b*, having regard to the direction of travel of the needles in their path as shown by directional arrow in FIG. 20 and the blast from the nozzles is directed into the open side of the needle hook 6*a* of each affected needle 6 as it passes thereby. Thus, should it be necessary to partially unload a needle after it has gathered fiber from the doffer 22*a*, the air nozzle 210 will be operated with a selected velocity of air blast or stream or jet to dislodge as much of the fibers from the needle as will accomplish the desired purpose. On the other hand if a needle that has gathered fibers from the doffer 22*b* needs to be partially unloaded, the air nozzle 211 will be caused to function. By properly modulating the air stream from either of the nozzles 210 and 211 as required, a wide range of fiber unloading results can be attained. Means for controlling the nozzles 210 and 211 comprise respective modulating valves 212 in air lines 214 deriving air under pressure from a source 215. Control of the modulating valves 212 may be by control means 217 responsive to either or both pattern means 218 and fiber thickness sensitive means 219 suitably located in association with the doffer 22**. The mechanics of this means whereby air stream unloading occurs resides in that not all individual fibers are lodged equally in the needle hooks, some engage the hook at about the center of the fiber and others engage at varying distances from center of the fiber. Those fibers engaged near their ends will be easily dislodged from the needle hook by the air, and fibers engaged further from the ends will require greater air velocities to become dislodged.

In FIGS. 21–26 is depicted adaptation of the present invention to a knitting machine with slide latch needles controlled by jacks, on the order of the machine represented in U.S. Pat. to Schmidt et al No. 3,535,892 which is incorporated herein by reference to any extent necessary. In such an arrangement slide latch needles 220 each of which has a knitting hook 221 and a slide latch rod element 222 reciprocable therein into opening and closing relation to the hook 221 are mounted in a needle cylinder 223 rotatably mounted in a cam box 224. Each of the needles 220 has a needle foot 225 reciprocably mounted in a vertical slot 227 in the perimeter of the cylinder 223 with a needle butt 228 overlying a needle foot 229 of the associated latch rod 222 and which has on its lower end a latch butt 230.

Means for controlling each of the needles 230 and its latch 222 not only for normal deep pile fabric knitting, but also for regulating the quantity of pile fibers transferred by the knitting needles from the respective ones of the fiber delivery zones to the knitted fabric, comprise, among other things, a jack 231 for each needle and means for controlling the jack. Normally the jack is biased by means of a spring 232 to privot about a lower end 231*a* toward a wire spring rod 233 with which a contact projection 234 of the jack is aligned. The spring rod is anchored to a mounting ring 235 fixed corotatively with the cylinder 223 so that the spring rod travels with the jack 231 controlled by the rod.

As the cylinder rotates, the spring rods 233 of the respective needles 220 are controlled electromagnetically to determine any of various desired positions of the jack relative to the associated needle. To this end, as the cylinder rotates and the respective needles 220 approach a fiber zone, the control rods 233 ride onto a deflecting cam 237 toward the face of a permanent magnet 236 which normally maintains the control rodsin a fully deflected path wherein the jacks 231 are biased by the springs 232 to ride a cam track 238 received in a follower notch 239 in the edge of each of the jacks opposite to the edge thereof against which the associated spring 232 engages. Assuming that this condition prevails, the respective jack 231 will ride along the cam track 238 and will be driven upwardly on a cam lobe 240 (FIG. 25) to engage the associated needle foot 225 and the latch foot 229 and divert them from respective track grooves 241 and 242 for the butts 228 and 230, respectively, into cam grooves 243 and 244, respectively, leading therefrom to drive the needle and its latch upwardly into fiber taking relation in the associated fiber zone. If program control means 245 (FIG. 24) signals that no fiber is to be taken by any particular needle, an electrical winding 247 is energized thereby to demagnetize the magnet 236, whereby that particular needle control rod 233 springs away from the magnet into a gap 248 and is shunted by a cam 249 to run into an ejection groove 250 (FIGS. 21 and 24), wherein the associated jack 231 is held in inactive position and the cam 238 is bypassed.

Assuming that the program control means requires a fiber taking cycle of any particular needle 220, the control rod 233 for that needle will travel on toward the face of a second magnet 251. If the program control means 245 continues to call for full fiber taking action of the particular needle, a coil 252 is energized to demagnetize the magnet 251 and the upper end of the selected control rod 233 drops into an open track 253 (FIGS. 22 and 24) wherein the associated jack 231 is controlled to raise the needle and not the needle latch in the normal sequence. However, should the program control means detect a situation wherein both the needle and the latch should be controlled, the magnet 251 will be permitted to attract the selected control rod 233 to remain deflected so that its upper end will ride along a control track 254 (FIGS. 23 and 24) and thus remain for at least a substantial length of time until shunted by a cam 255 into the track 253. While control rod 233 is sliding along cam track 254, its respective jack 231 will be deflected outward by bias spring 232 so that jack 231 can be raised by cam 238 while deflected outwardly so as to engage both the latch base 230 and the needle base 225 causing them also to raise and be controlled by upper cam tracks 244 and 243 respectively, thereby selectively controlling the opening and closing of the latch of the associated needle.

In order to increase the range of selective opening and closing of the latch 222 for any given needle as determined by the program control means 245, the cam track 244 for the latch butt 230 is provided with a contractible and extensible partial needle open extent 257 (FIG. 25) following a latch closed extent 258. To effect variation in the length of the partial needle open extent 257 of the cam track, coupled cam elements 259 are adapted to be actuated by a suitable actuator 260 such as a solenoid, the armature of which is normally biased by means of a spring 261 into maximum track length position of the cam elements 259. When it is desired to shorten the length of the partial open track length 257, the actuator 260 is energized to retract the cam elements 259 toward the right as shown in the drawing to that the selected latch butt 230 will be deflected by the cam 259 into the track 242 sooner than the normal setting. By controlling the position of the cam members 259 a substantial range of incremental partial open positions of the needle latches can be attained.

Figure 26:
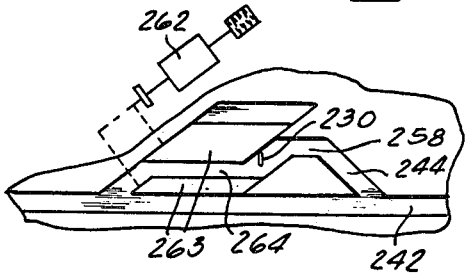
FIG. 26 is a schematic view illustrating a modified control cam means for the device of FIG. 21.

In FIG. 26 another variable control adjustment for the needle latches is depicted wherein a control actuator 262 connected to jointly movably coupled cam elements 263 controls the needle latches between fully closed to virtually fully opened relation to the associated needle head by providing a needle latch control groove section 264 which as an extension from the fixed control groove 258 can be adjusted selectively from a shallow to a deeper deflection of the latch butt 230 of the selected needle. Thus, when it is desired to increase the needle load, the needle latch is opened to the maximum extent permitted by adjustment of the groove section 264. Lesser needle loads are provided for by adjusting the cam elements 263 generally upwardly from the position shown in FIG. 26 so that lesser opening of the needle latch will prevail while under the control of the groove section 264.

Figure 11:
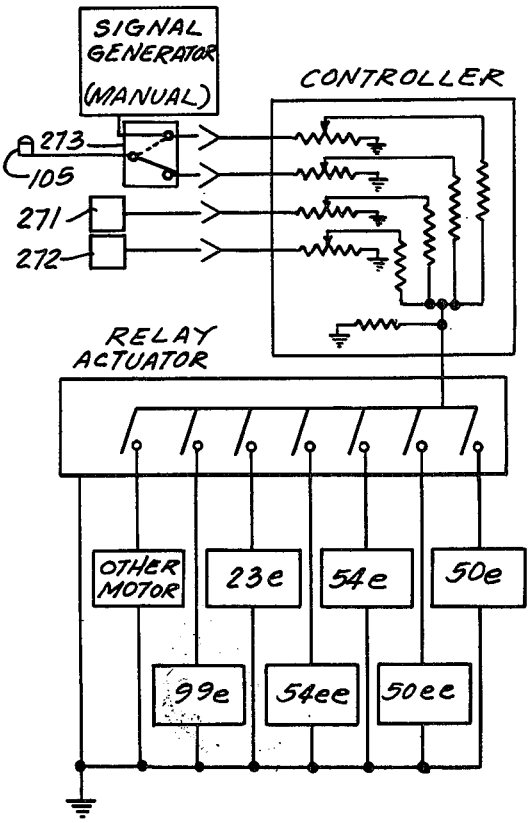
FIG. 11 is a diagram illustrating a control circuit useful in accordance with the present invention.

It will be observed from the above descriptions, that various means are provided for regulating or providing a change or modulation in needle load or quantity of pile fibers transferred by the knitting needles from the respective ones of the zones to the knitted fabric. Controlled increase or decrease in needle fiber load or quantity is effected by the energization of means such as air jet, suitable actuator or control motor, i.e., solenoid, electro-magnet, hydraulic or pneumatic device, and the like. The control or regulating means may readily be actuated by a conventional manual switch (FIG. 11).

However, a substantial advantage is provided by rendering such control automatic, electronically operated or computerized. Automatic dynamic control may be provided by sensing a variation in fiber quantity such as a fiber build-up condition or, alternatively, a fiber diminution, scant or thinning condition, in a fiber feeding zone provided by any suitable means of which the doffers 22*a*, 22*b* are one desirable means. Such control means may comprise transducer means which provide an oppositely directed beam of light source 270 and light beam sensitive pick-up stations 271, 272, associated with each pair of doffers 22*a*, 22*b* as shown in FIGS. 1 and 2 and also referring to FIG. 11. Increased density, or alternatively, increased illumination, between the source 270 and receiving sensing station 271, 272 will provide through suitable amplifier and signal generating means, a control signal for energizing one or more of the controllable means associated with any selected form of this invention, such as a respective one or more of the cam motors 50*e*, 50*ee*, 54*ee* or of the control motors 23*e*, 99*e*, 260, 262 or of the electromagnets 181, 182, 184, 185, 189, 247, 252, or the control actuators for the valves of the air nozzles 210, 211, or any other preferred means for the present purpose functioning during operation of the knitting apparatus for reducing needle pickup from a fiber feeding zone thus sensed as having an excessive buildup of fiber or, alternatively, for increasing needle pickup where a scant supply of fiber is sensed.

A recording of the sensed impulses from stations 271, 272 may be made electronically by any conventional magnetic or optical recorder and applied to the control tape 100, either magnetically or optically. A combination record and playback for reading this recorded data on the tape 100 may be provided as by means of a head 105 (FIGS. 6 and 11) which may operate as a playback head to provide a sequential control resulting from the previously recorded control signals or data, as above described. Such a record tape may also be derived from manual observation or from a computer program. Actuation of a switch 273 from the full line position to the dashed position shown in the diagrammatic control system in FIG. 11 during manual control will apply manual signals to head 105 for original or superimposition recording onto tape 100 by means of conventional magnetic recording circuitry (not shown), thereby recording the manual control pattern thus provided in superimposed position for subsequent cycles run after reversing switch 273. Such empirical control capability, although seemingly less sophisticated than a fully automatic system, may well in practice prove the least expensive method of establishing a most effective program for controlling individual needles according to the present invention in an already-tape-controlled system such as described in prior U.S. Pat. No. 3,709,002.

Still other modifications and variations will be evident to persons skilled in the art. Although not illustrated in the drawings, it will be clear to those skilled in the art that the invention may incorporate additional controllable means within the concepts of the present invention for regulating the quantity of pile fibers transferred by the knitting needles from the respective ones of the fiber zones to the knitted fabric.

We claim as our invention:

1. In a pile fabric circular knitting apparatus including a rotatable needle cylinder and reciprocatable knitting needles therein, supply means for delivering fibers to a plurality of feeding means providing zones spaced about the circumference of the cylinder wherein the fibers are picked up by certain of said knitting needles as they are selectively reciprocated into the respective zones, and yarn feed means for delivering backing yarn between certain of said zones to be picked up by the knittig needles actuated to receive said yarn, the combination which comprises: means for selectively reciprocating the individual knitting needles into said zones to cause the needles to remove fibers from the zones for transfer to knitted fabric; pattern means controlling said supply means to vary the amount of fibers supplied to the respective zones; controllable means separate from said supply means selectively regulating the cooperative relationship of the needles with the zones to modify the quantity of fibers that said knitting needles will transfer from a respective one of said zones to the knitted fabric; dynamic control means functioning with the apparatus in continuous and uninterrupted operation, for actuating said controllable means, whereby to control the density of pile in the knitted fabric; and means separate from said controllable means and said dynamic control means for reciprocating the needles to pick up yarn from said yarn feed means and integrate the fibers and the yarn into interlocking loops of the knitted fabric, said needles comprising companion relatively slidably operative needle elements one of which elements is adapted to transfer more fiber than the other of said elements, and said controllable means being operative to select said elements for picking up fiber in any of the respective zones.

2. Apparatus according to claim 1, wherein said one of the needle elements has a maximum open hook to receive a maximum quantity of fibers therein and the other of the needle elements has a hook partially closed to receive a minimum quantity of fibers therein.

3. Apparatus according to claim 1, wherein said companion needle elements work in a common slot in the needle cylinder.

* * * * *